United States Patent [19]

Howie, Jr.

[11] 4,417,483

[45] Nov. 29, 1983

[54] CALIBRATABLE DIAL

[75] Inventor: Robert K. Howie, Jr., Decatur, Ill.

[73] Assignee: The Grigoleit Company, Decatur, Ill.

[21] Appl. No.: 325,326

[22] Filed: Nov. 27, 1981

[51] Int. Cl.[3] ..... G05G 1/10

[52] U.S. Cl. ..... 74/553; 16/121; 116/309

[58] Field of Search ..... 74/553; 16/121; 116/309, 315, 318

[56] References Cited

U.S. PATENT DOCUMENTS

| | | | |
|---|---|---|---|
| 1,552,052 | 9/1925 | Danielson et al. . | |
| 2,202,371 | 5/1940 | Bruckman . | |
| 2,552,102 | 5/1951 | Lyons | 74/553 |
| 2,826,934 | 3/1958 | Jakeway . | |
| 2,899,841 | 8/1959 | Melloy . | |
| 3,061,869 | 11/1962 | Scalo et al. . | |
| 3,176,541 | 4/1965 | Keeling, Sr. et al. . | |
| 3,342,082 | 9/1967 | Davidson . | |
| 3,396,604 | 8/1968 | Samuels et al. . | |
| 3,543,605 | 12/1970 | Sherman . | |
| 3,596,630 | 8/1971 | Edelman . | |
| 3,597,996 | 8/1971 | Gouwens et al. . | |
| 3,916,721 | 11/1975 | Egger . | |
| 4,012,806 | 3/1977 | Howie, Jr. . | |

FOREIGN PATENT DOCUMENTS

| | | | |
|---|---|---|---|
| 1131478 | 6/1962 | Fed. Rep. of Germany | 74/553 |

*Primary Examiner*—Kenneth Dorner

*Attorney, Agent, or Firm*—Kinzer, Plyer, Dorn & McEachran

[57] ABSTRACT

A calibratable dial for mounting on a control shaft. The dial includes a hub and a skirt frictionally fastened to each other for rotational movement in unison. The hub has a generally cylindrical portion and a disc portion. A shaft receiving socket is formed in the generally cylindrical portion of the hub. A central opening is formed in the skirt and is sized to fit over and receive the generally cylindrical portion of the hub when the skirt and hub are frictionally fastened to each other. An arcuate toothed sector is formed in the skirt along one portion of the central opening thereof at a location overlying the disc portion of the hub. Instrument receiving sockets are formed in the hub in alignment with the central opening in the skirt. The sockets are positioned to extend under the arcuate toothed sector of the central opening of the skirt so that an instrument inserted in either of the sockets will engage the hub and the toothed sector of the skirt. Upon twisting of the instrument, frictional engagement between the hub and skirt will be overcome to rotate the hub and skirt relative to each other through a limited arcuate extent.

4 Claims, 3 Drawing Figures

CALIBRATABLE DIAL

SUMMARY OF THE INVENTION

This invention is concerned with a calibratable dial for mounting on a control shaft, particularly a shaft used to select and control temperature.

An object of this invention is a dial which can be calibrated relative to a control shaft.

Another object is a dial for a control shaft which can be incrementally calibrated relative to the control shaft.

Another object is a dial which can be calibrated without disassembly of the dial from its shaft.

Another object is a dial which can be positively calibrated in increments of degrees of temperature.

Other objects may be found in the following specification, claims and drawings.

BRIEF DESCRIPTION OF THE DRAWINGS

The invention is illustrated more or less diagrammatically in the following drawings wherein.

DESCRIPTION OF THE PREFERRED EMBODIMENT

Figure 1:
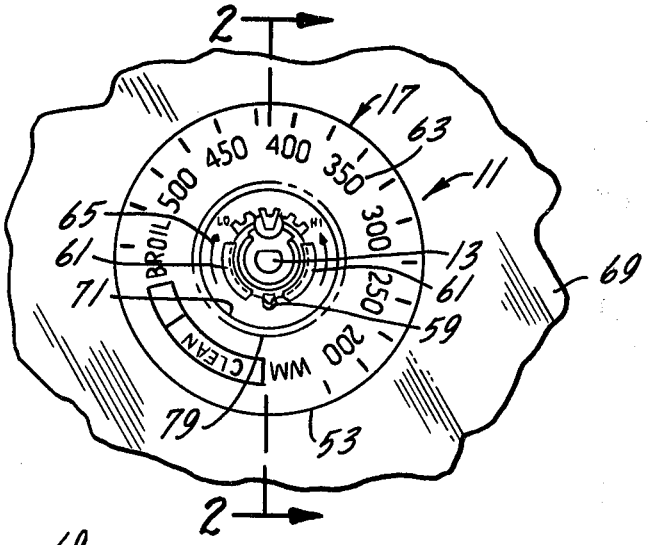
FIG. 1 is a front view of the calibratable dial of this invention mounted on a control shaft with the operating knob omitted for clarity of illustration.
Figure 2:
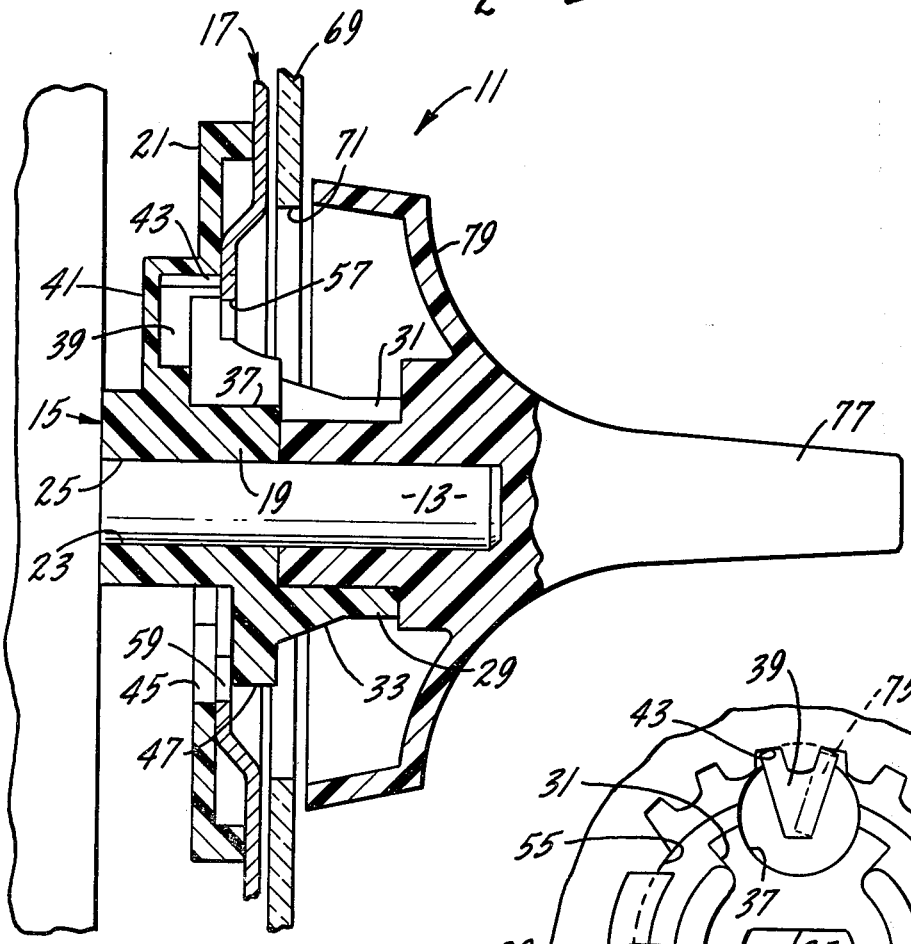
FIG. 2 is an enlarged cross sectional view taken along line 2—2 of FIG. 1 with parts broken away.
Figure 3:
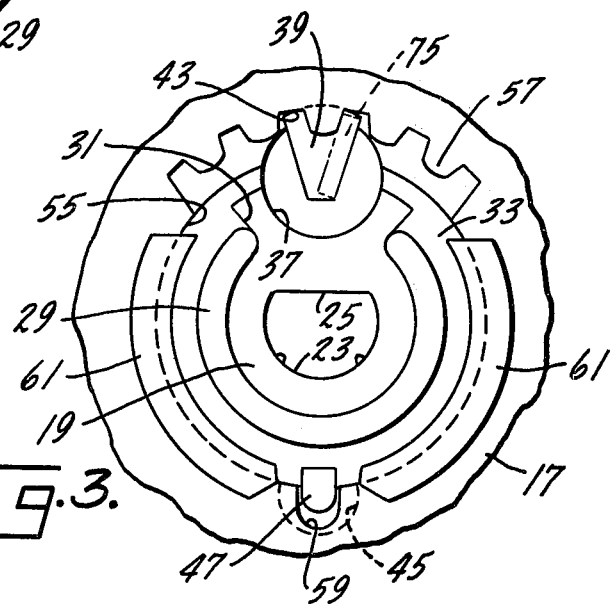
FIG. 3 is an enlarged partial front plan view showing the calibration portion of the dial with a calibration instrument inserted in the hub socket and shown in phantom.

A calibratable dial 11 embodying the novel features of this invention is shown in FIGS. 1 through 3 of the drawings. This calibratable dial is intended to be mounted on a shaft 13 of a temperature control mechanism such as a valve or a rheostat. The particular dial shown in the drawings is adapted for use on a shaft controlling a gas valve or an electrical rheostat on a stove or oven. However, the calibratable dial of this invention should not be limited to only these enunciated uses but may also be used on any control device having a dial which must be calibrated relative to a rotatable shaft.

The calibratable dial 11 of this invention includes a hub 15 which may be molded of a suitable plastic. The skirt 17 which attaches to the hub is formed of a metal stamping, preferably aluminum. The hub 15 includes a generally cylindrical portion 19 and a disc portion 21 formed integrally with the cylindrical portion and located intermediate the ends thereof. A shaft receiving socket 23 is formed in the generally cylindrical portion 19 and this socket includes a flattened wall 25 on one side of the socket.

A thin tubular wall 29 extends from the generally cylindrical portion 19 of the hub on one side of the disc. This wall has an opening 31 formed on one side thereof and tapered outer surfaces 33 at the base of the tubular wall. A circular socket 37 is located in the disc and aligned with the opening 31 formed in the tubular wall 29. An arcuate socket 39 is located in the base of the circular socket and extends into a protuberance 41 extending from the opposite side of the disc 21. An arcuate wall 43 of the socket extends radially outwardly slightly beyond the wall of the circular socket 37.

An opening 45 is formed in the disc adjacent the cylindrical portion 19 and is located diametrically opposite the circular socket 37. A projecting tab 47 formed on the cylindrical portion is aligned with and framed within the opening 45.

The skirt 17 has a bent down outer rim 53. An opening 55 is formed in the center of the skirt by stamping. The opening is sized to fit over and snugly receive the generally cylindrical portion 19, specifically the thin tubular wall 29, of the hub. The central opening 55 includes an arcuate toothed sector 57 having six notches. Another notch 59 is formed on the diametrically opposite side of the central opening 55 to receive the tab 47 of the cylindrical portion for alignment purposes.

When the skirt 17 is assembled in proper alignment over the thin tubular wall 29 of the generally cylindrical portion 19 of the hub 15, it is heat staked thereto by a tool which engages the tapered outer surfaces 33 to form ears 61 which overlie the skirt 17 to prevent axial movement of the skirt relative to the cylindrical portion while allowing relative rotational movement between these parts. The tab 47 is positioned in front of the face of skirt 17 in the manner shown in FIG. 2 so that it does not interfere with the rotation of the cylindrical portion 19 of the hub relative to the skirt 17 beyond the arcuate extent of the notch 59 to permit calibration over the entire extent of the toothed sector 57. The staking of the skirt 17 to the hub 15 will bend the disc portion 21 of the hub thus using the elasticity of the hub to provide frictional resistance to rotation of the parts. If the plastic hub is not sufficiently elastic to perform this function, the aluminum skirt 17 would be designed to deform within its elastic limit to provide spring tension to resist relative rotation of the parts.

Indicia 63 indicating temperatures, either in the Fahrenheit or Celsius scales, are applied to the surface of the skirt 17 near the outer rim 53 thereof. Additional indicia 65 consisting of arrows and the words "low" and "high" are also printed on the skirt adjacent the central opening 55 for calibration purposes.

When installed over a shaft 13 of a temperature control mechanism such as a valve or a rheostat of a stove or oven, the calibratable dial 11 of this invention is positioned behind a sheet of glass 69 or suitable plastic. An opening 71 is formed in the glass to receive the shaft 13 and to permit access to the sockets 37 and 39 by a suitable instrument. The instrument may be either a flat bladed screwdriver 75 or a torque screwdriver, which is not shown. When using a flat bladed screwdriver, the blade 75 engages a tooth 57 on the skirt 17 and the wall of the socket 39 to turn the skirt relative to the hub 15 and the control shaft 13. When a torque screwdriver is used, it is inserted into the socket 37 and reacts with the walls of the socket and the teeth 57 on the skirt 17 to rotate the skirt relative to the control shaft 13.

A knob 77 having a flared base 79 fits on the shaft 13 with the flared base 79 covering the central opening 55 of the skirt, the opening 71 in the glass plate 69 and the indicia 65. The knob is removed for calibration of the dial.

I claim:

1. A calibratable dial for mounting on a control shaft, said dial including:

a hub and a skirt frictionally fastened to each other for rotational movement in unison, the hub having a generally cylindrical portion and a disc portion, a shaft receiving socket formed in the generally cylindrical portion of the hub;

a cental opening formed in the skirt and sized to fit over and receive the generally cylindrical portion of the hub when the skirt and hub are frictionally fastened to each other, an arcuate toothed sector formed in the skirt along one portion of the central opening of the skirt at a location overlying the disc portion of the hub, and an instrument receiving socket formed in the hub in alignment with the central opening in the skirt and positioned to extend under the arcuate toothed sector of the central opening of the skirt so that an instrument inserted in the socket will engage the hub and the toothed sector of the skirt and upon twisting will overcome the frictional engagement between the hub and skirt to rotate them relative to each other through a limited arcuate extent.

2. The calibratable dial of claim 1 in which the instrument receiving socket is wedge shaped with the wedge having an arcuate extent approximately equal to two teeth of the arcuate toothed sector to limit the rotational adjustment of the skirt and hub relative to each other during a single twisting movement of the instrument.

3. The calibratable dial of claim 1 in which alignment means are formed on the hub and skirt with the alignment means includes a notch formed in the skirt and a projection formed on the hub with the projection located entirely in front of the skirt so that the hub and skirt can be rotated relative to each other beyond the arcuate extent of the notch.

4. The calibratable dial of claim 3 in which stops are located on opposite arcuate sides of said arcuate toothed sector and the wedge shaped instrument receiving socket extends radially inwardly of the stops so that the instrument engages the stops to limit rotational adjustment of the dial relative to the knob.

* * * * *